US006551071B1

(12) United States Patent
Blender et al.

(10) Patent No.: US 6,551,071 B1
(45) Date of Patent: Apr. 22, 2003

(54) MULTIPLE-FLOW LIQUID RING PUMP

(75) Inventors: Helmut Blender, Stetten (DE); Rolf Jäger, Schopfheim (DE); Karl-Heinz Kulas, Lörrach (DE); Horst Masuch, Schopfheim (DE); Patrick Müller, Todtmoos (DE); Wolfgang Tempel, Schopfheim (DE)

(73) Assignee: Gardner Denver Wittig GmbH, Schopfheim (DE)

( * ) Notice: Subject to any disclaimer, the term of this patent is extended or adjusted under 35 U.S.C. 154(b) by 0 days.

(21) Appl. No.: 09/581,390

(22) PCT Filed: Dec. 16, 1998

(86) PCT No.: PCT/DE98/03752

§ 371 (c)(1),
(2), (4) Date: Jul. 16, 2001

(87) PCT Pub. No.: WO99/32791

PCT Pub. Date: Jul. 1, 1999

(Under 37 CFR 1.47)

(30) Foreign Application Priority Data

Dec. 22, 1997 (DE) ..... 197 58 340

(51) Int. Cl.[7] ..... F04C 19/00
(52) U.S. Cl. ..... 417/68
(58) Field of Search ..... 417/68, 54, 372, 417/69, 238, 521

(56) References Cited

U.S. PATENT DOCUMENTS

| | | | | |
|---|---|---|---|---|
| 4,132,504 A | | 1/1979 | Fitch | |
| 4,637,780 A | | 1/1987 | Grayden | |
| 4,737,073 A | | 4/1988 | Grayden | |
| 4,795,315 A | * | 1/1989 | Schultze | 417/244 |
| 5,401,141 A | | 3/1995 | Siebenwurst | |
| 5,588,806 A | * | 12/1996 | Trimborn et al. | 417/54 |
| 5,605,445 A | * | 2/1997 | Trimborn | 417/68 |
| 5,899,668 A | * | 5/1999 | Shenoi et al. | 417/68 |

FOREIGN PATENT DOCUMENTS

| | | |
|---|---|---|
| DE | 28 41 906 | 6/1979 |
| DE | 1111355 | 7/1996 |
| EP | 0 012 544 | 12/1982 |
| EP | 0 033 726 | 7/1984 |
| EP | 0 742 371 A2 | 11/1996 |

OTHER PUBLICATIONS

International Search Report, PCT/DE 98/03752.
English abstracts of Japanese patents: Appln. No. 53–110879, Date: Mar. 15, 1980; Appln. No. 53–111018, Date: Mar. 15, 1980 Appln. No. 53–111045, Date: Mar. 15, 1980.

* cited by examiner

*Primary Examiner*—Teresa Walberg
*Assistant Examiner*—Vinod D Patel
(74) *Attorney, Agent, or Firm*—Barnes & Thornburg; Robert F. I. Conte

(57) ABSTRACT

The invention relates to a multiflow liquid ring pump, comprising a rotor housing that encompasses the pump rotor. A side shield is arranged on both front ends. Each side shield has an inlet and an outlet on the side facing the other side shield, the inlet and outlet being interconnected. An admission hole for the feed line and a pressure hole for the discharge line are provided. Each side shield has at least one additional connection hole. The invention is characterized in that the outer jacket surface of each side shield (3, 4) flushes with and closes the outer jacket surface of the rotor housing (2) and in that the inlet (7, 9), the outlet (8, 10) and the connection hole (11, 12, 13, 14) are connected by channels (15, 16, 30, 31) arranged in the rotor housing (2).

9 Claims, 6 Drawing Sheets

MULTIPLE-FLOW LIQUID RING PUMP

FIELD OF THE INVENTION

The invention relates to a multiple-flow liquid ring pump.

DESCRIPTION OF RELATED ART

A liquid ring pump is known from U.S. Pat. No. 4,132,504. The rotor housing has a substantially circular cross-section. Ribs of lengthwise extension, which stand out radially and which, towards the inside, define channels, are disposed on the surface, in the shape of a cylinder jacket, of the rotor housing. A drawback of this arrangement resides in that the space maximally taken by the housing of the liquid ring pump, i.e., height times width, is substantially greater than needed by the cylinder-jacket shape of the rest of the rotor housing. Moreover, the projecting ribs form dead spaces where dirt can accumulate. Further, handling the liquid ring pump is accompanied with the risk that someone might be caught by the projecting ribs.

A liquid ring pump of the species is known from EP 0 584 106 B1. It is a multiple-flow liquid ring pump having a rotor housing which surrounds the rotor of the pump and on each of the two end sides of which a side shield is arranged. The two side shields extend beyond the rotor housing in the radial direction and each side shield has, in its projecting region, an inlet opening and an outlet opening on the side facing the other side shield. These openings are connected to each other by connecting tubes which extend parallel to the rotor housing, a suction opening being provided for a feed line and a delivery opening for a discharge line. Further connecting openings can be provided in the two lower corners, serving for the supply of operating liquid and/or for pressure compensation between the two halves of the pump. These openings are also connected via tubes that are parallel to the rotor housing. A support arm is molded on both side shields, comprising the bearings for the shaft of the rotor.

A drawback of this construction resides in the space required by the bearing disposed in the support arm and in the increased mounting requirements for the installation of the connecting tubes. The high number of projecting parts in the overall construction, such as the support arm and the connecting tubes, form nests for the accumulation of dirt which is rather difficult to remove.

SUMMARY OF THE INVENTION

It is the object of the invention to provide a liquid ring pump of the generic type which is more compact and space-saving as compared to the known prior art.

Attaining this object proceeds from the preamble of claim 1, taken in conjunction with the characterizing features thereof. Advantageous embodiments are specified in the sub-claims.

According to the invention, the outer jacket surface of each side shield is flush with the outer jacket surface of the rotor housing and the connection of the inlets and outlets as well as the connecting ports takes place via channels disposed in the rotor housing. This type of arrangement has the advantage that there are no projecting components forming nests for the accumulation of dirt, the whole aggregate consequently being cleaned more easily. Another advantage resides in that there is no need for the installation of separate connecting tubes, because they are an integral part of the rotor housing. They can for example be cast directly during manufacture. The side shields can easily be flanged on the respective end face of the rotor housing by means of through-bolts. The cross section of the rotor housing is approximately square, the side faces being curved slightly outwards and rounded where they pass into the areas of the lateral edges. The connecting channels are located in the crotches which result between the rotor housing of nearly square cross-section and the round working area, the working area being approximately centric of the rotor housing. Approximately means that the working area is either equi-axed or by some millimeters eccentric of the rotor housing. For example, the axis of the working area is eccentric of the axis of the rotor housing by five millimeters in the direction of the twelve o'clock position. Regardless of the eccentricity which correlates with the dynamic operating performance of the pump, the drill hole of the rotor housing can be displaced relative to the outer contour, preferably in the direction of the 6 o'clock position. As a result, centric of the rotor housing. Approximately means that the working area is either equi-axed or by some millimeters eccentric of the rotor housing. For example, the axis of the working area is eccentric of the axis of the rotor housing by five millimeters in the direction of the twelve o'clock position. Regardless of the eccentricity which correlates with the dynamic operating performance of the pump, the drill hole of the rotor housing can be displaced relative to the outer contour, preferably in the direction of the 6 o'clock position. As a result, the incorporated cross-sectional geometry of the upper suction and pressure channels can be made greater than the lower channels for operating liquid and dirt particles. The advantage consists in that by this measure, the cross-sectional areas can be adapted to the required volume flows and the flow rates resulting therefrom.

In known manner, one of the lower connecting ports is provided for the supply of operating liquid. According to the invention, the second connecting port is a dirt particle discharge channel provided with connecting channels which are radial of the working area. In this way, any dirt particles entrained are catapulted off by centrifugal forces in the working area and are forced by the centrifugal forces through the ports in the wall of the working area into the lengthwise discharge channel. At certain intervals, the dirt particles accumulated in the discharge channel can be removed.

So as to render the installation of the connecting lines as flexible as possible, depending on the situation of incorporation, a further development of the invention proposes to skew the end face area of the side shield that is turned away from the rotor housing and possesses the inlet and outlet opening. Preferably, this skew is in the range of 45°. This has the advantage that the supply line can be installed, saving space upwards as well as forwards. In like manner, inlet and outlet openings of equal design are formed on both side shields; they can be closed alternately so that the connection of the supply line and the delivery line may take place optionally on one of the two sides of the liquid ring pump. This principle of optional supply from one side or the other also applies to the operating liquid. Distribution to the necessary places then takes place via the connecting channel integrated in the rotor housing. For the purpose of avoiding any accumulation of dirt particles and having a compact constructional design, the invention provides the sealing as well as the bearing arrangement of the rotor shaft to be integrated in both side shields. Preferably, the sealing arrangement is disposed in a sealing housing and the bearing arrangement in a separate bearing housing. Both housings are screwed together and sealed. The advantage of this arrangement resides in that the unit of the sealing and bearing housing can be detached completely by being pulled off the rotor shaft. In this case, the rotor shaft is placed on two noses integrated in the respective cam disk. In this way it is possible to replace worn-out shaft packing rings without the entire machine having to be detached from the vehicle and dismantled completely.

Details of the invention will become apparent from the ensuing description of an exemplary embodiment of the multiple-flow liquid ring pump, taken in conjunction with the drawing, in which

BRIEF DESCRIPTION OF THE SEVERAL VIEW OF THE DRAWINGS

DETAILED DESCRIPTION OF THE INVENTION

Figure 1:
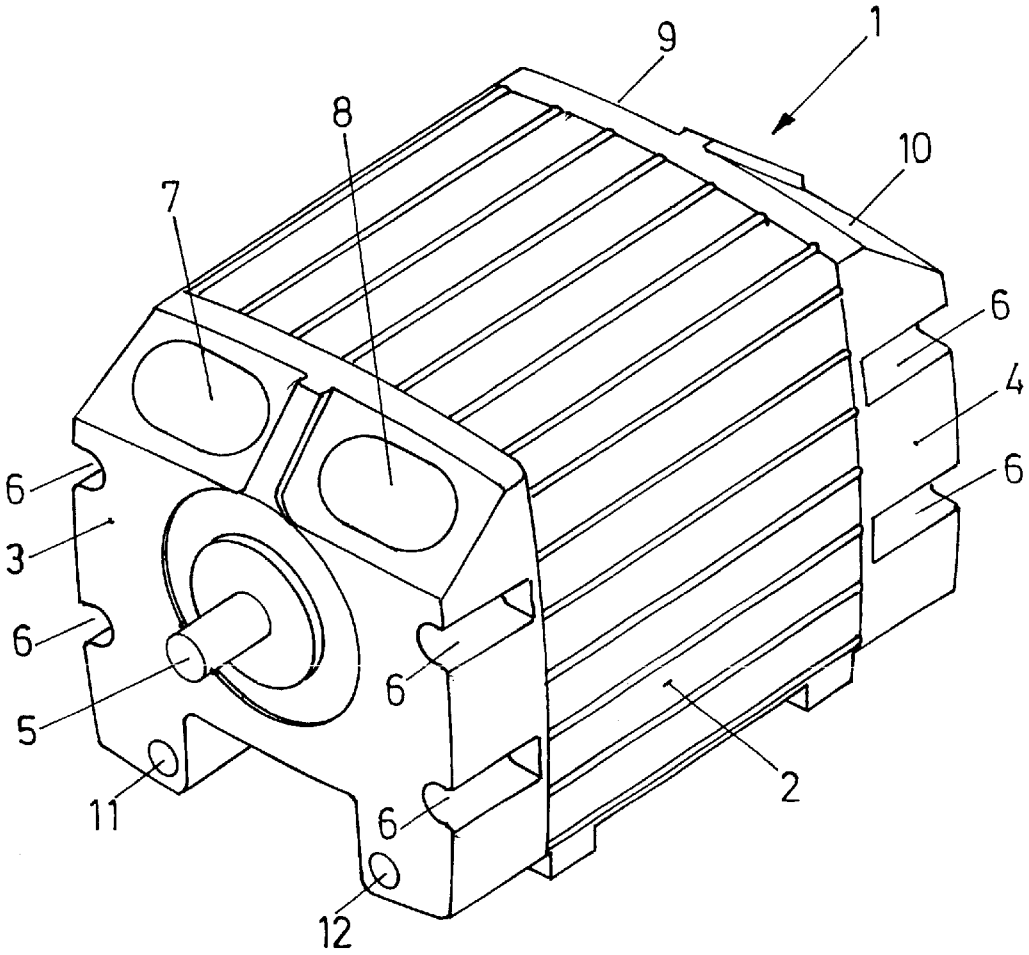
FIG. 1 is a perspective view of a multiple-flow liquid ring pump according to the invention.

FIG. 1 is a perspective view of a multiple-flow liquid ring pump 1 of a design according to the invention. It comprises a rotor housing 2 and two side shields 3, 4 attached thereto. The side shield 3, which lies in front in this illustration, constitutes the driving end with the rotor shaft 5 actuating the pump. This illustration clearly shows that the side shields 3, 4 are flush with the outline of the rotor housing 2. Each side shield comprises recesses 6 on both side faces, taking up through-bolts for the fastening of the side shields 3, 4 on the respective end face of the rotor housing 2. Openings 7, 8 are provided in the upper portion, the opening 7 on the left of the front side shield 3, in this embodiment, being the inlet for the suction side and the opening 8 on the right being the outlet for the delivery side. The rear side shield 4 comprises identical openings 9, 10. According to the invention, the lower portion of each side shield 3, 4 has at least one connecting port 12, 14, preferably for the supply of the operating liquid. However, another connecting port 11, 13 can be provided for instance as a dirt particle discharge channel. The openings 9, 10 and the connecting ports 13, 14 of the rear side shield 4 cannot be recognized in this illustration.

Figure 2:
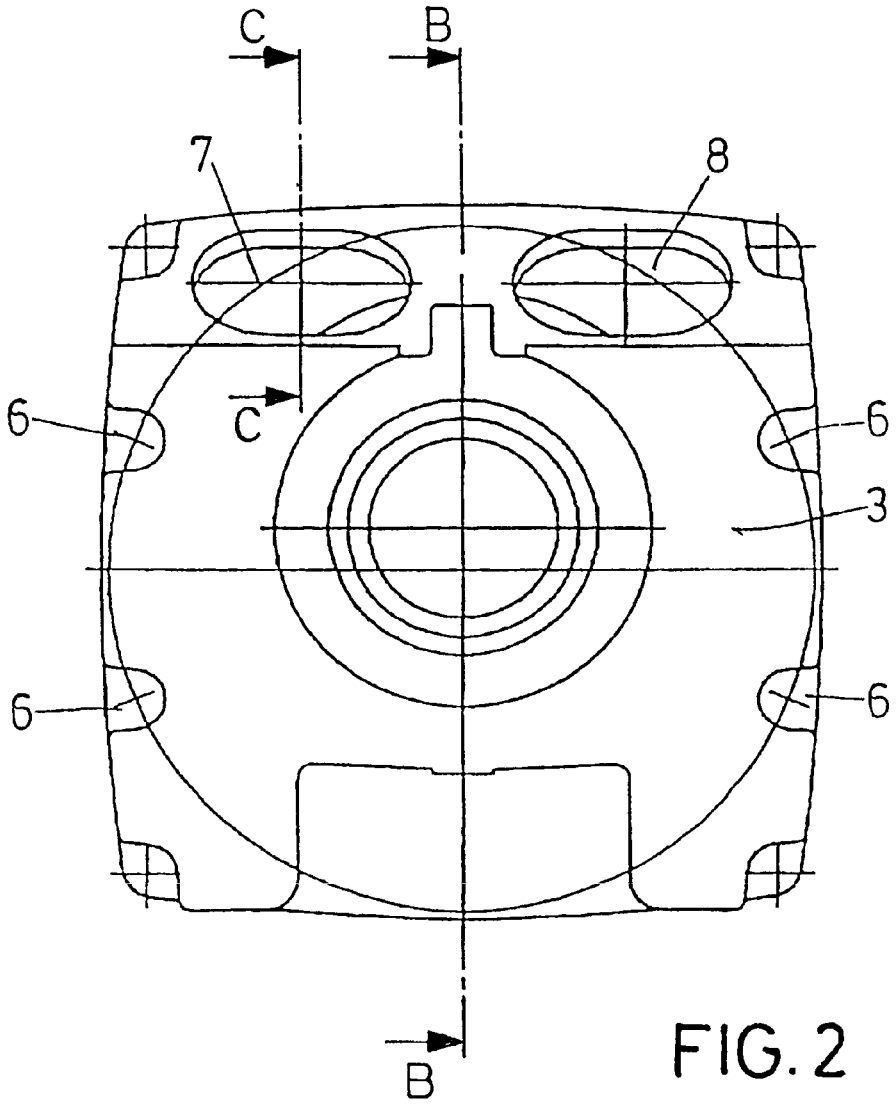
FIG. 2 is an elevation of a side shield in the cast condition.
Figure 4:
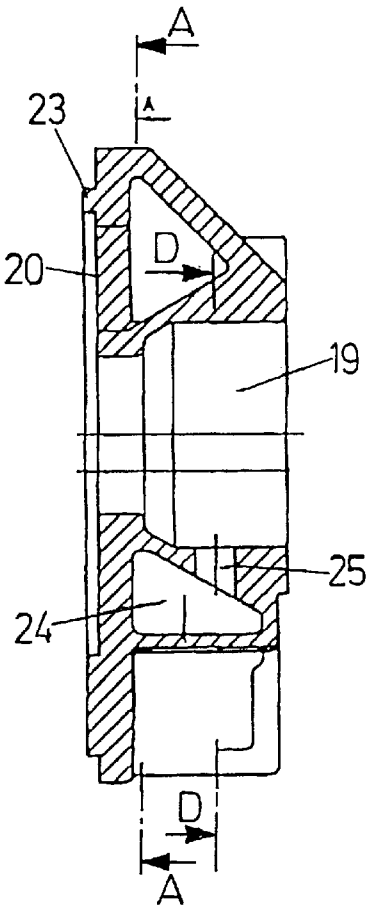
FIG. 4 is a sectional view on the line B—B in FIG. 2.
Figure 3:
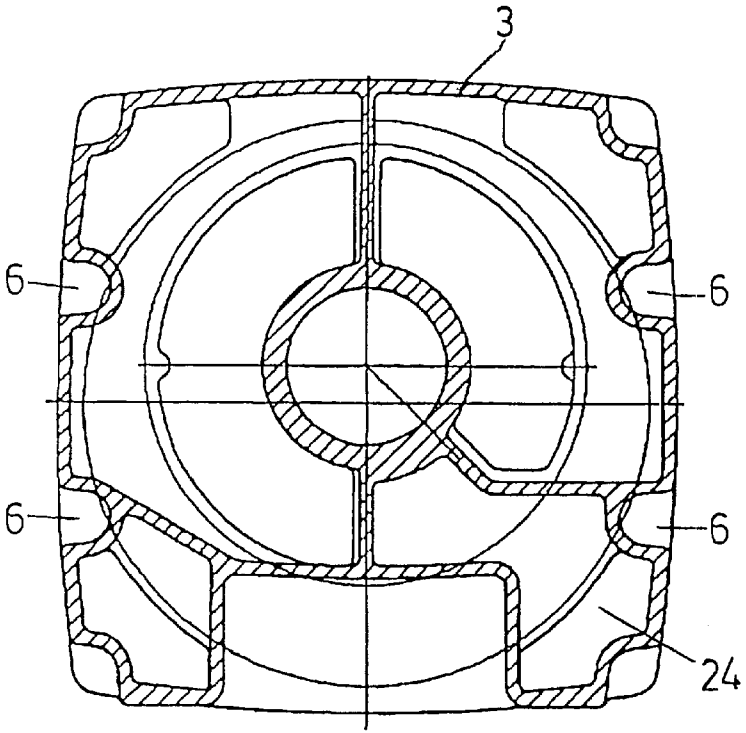
FIG. 3 is a sectional view on the line A—A in FIG. 4.
Figure 6:
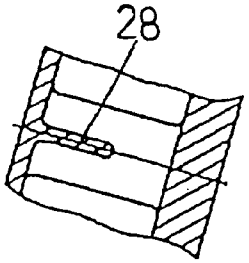
FIG. 6 is a sectional view on the line E—E in FIG. 5.
Figure 7:
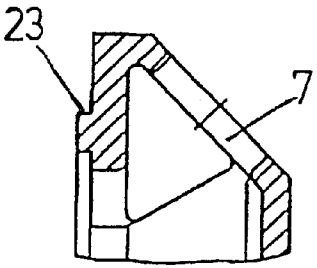
FIG. 7 is a sectional view on the line C—C in FIG. 2.
Figure 5:
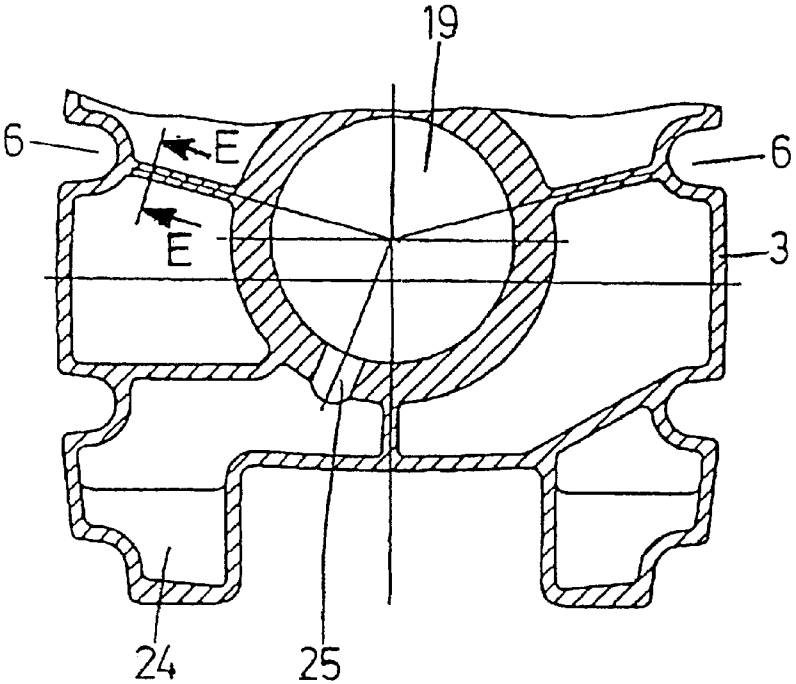
FIG. 5 is a sectional view on the line D—D in FIG. 4.

The subsequent FIGS. 2–7 illustrate details of the side shield 3 and 4, respectively, according to the invention. FIG. 2 shows the side shield 3, which lies in front in FIG. 1, in the cast condition. As can be seen, the inlet and outlet openings 7, 8 are incorporated during casting, whereas the lower connecting ports 11, 12 (FIG. 1) still have to be drilled.

FIGS. 3–7 are sectional or partial sectional views of the guidance of the channels within the side shield 3 here under regard. Owing to the double-flow design of the machine (see FIG. 8), the side shield 3, 4 enables the distribution of the gas, to be supplied or discharged, to take place into the chamber on the right in FIG. 8 on the one hand and via the channels 15, 16, which are disposed in the rotor housing 2, into the chamber on the left in FIG. 8 on the other hand. This is true for the suction side 17 as well as for the delivery side 18.

Figure 8:
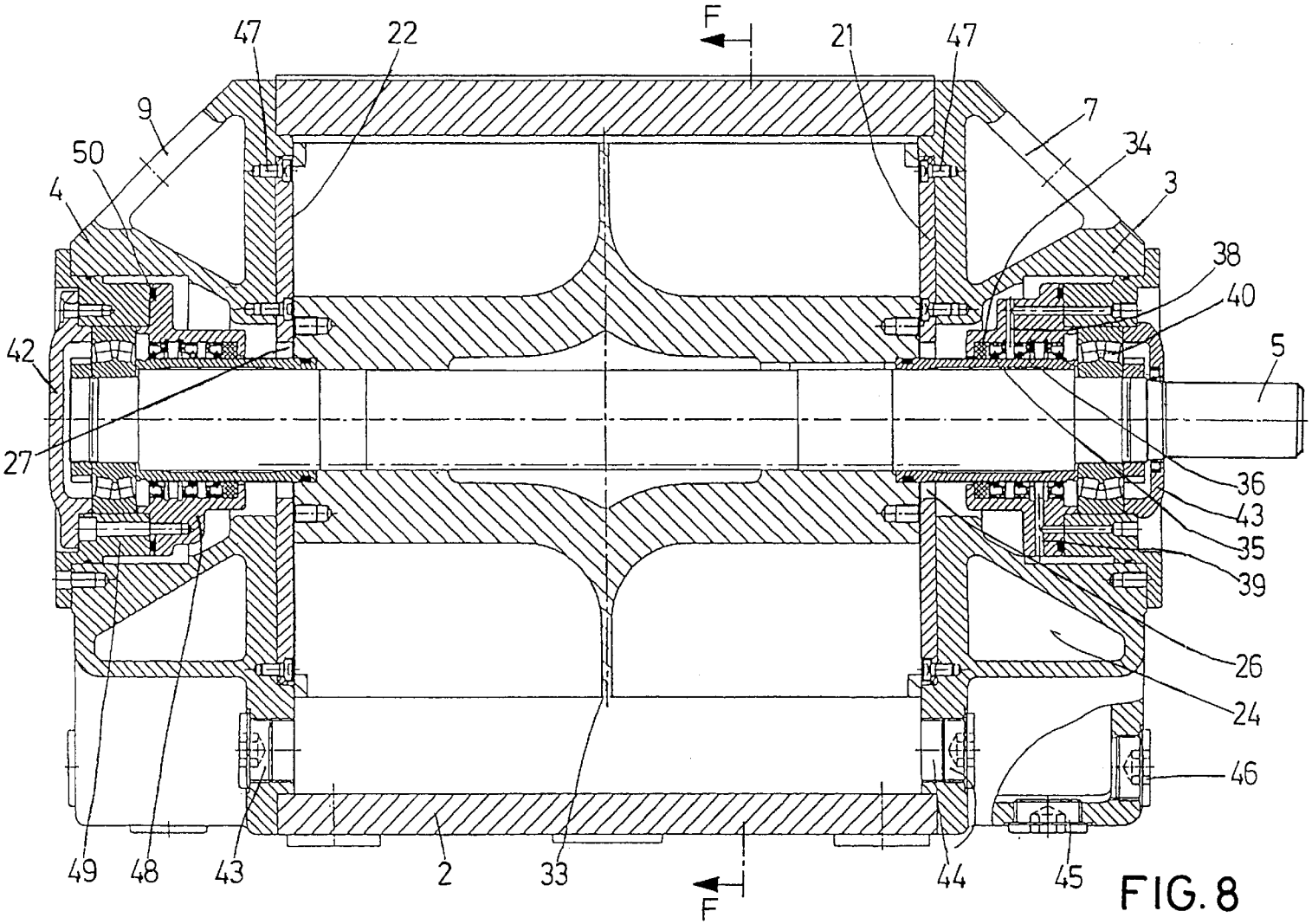
FIG. 8 is a longitudinal sectional view of the multiple-flow liquid flow pump according to the invention.

Each side shield 3, 4 comprises a central stepped hole 19 for the accommodation the sealing arrangement and the bearing for the rotor shaft 5 (FIG. 8). The respective cam disk 21, 22 (FIG. 8) is mounted on the internal end face 20 by means of screws 47 (FIG. 8). This end face 20 also comprises a centering shoulder 23 which stands out and on which the rotor housing 2 is centered. The supply of operating liquid takes place via the connecting port 12 and the channel 24, which extends in the side shield 3, via a hole 25 into the bearing area 19. From there it flows on via the opening 26, 27 provided in the respective cam disk 21, 22 into the working area of the respective chamber of the machine. According to FIG. 6, rigidifying ribs 28 are provided for the reinforcement of the respective side shield 3, 4.

Figure 9:
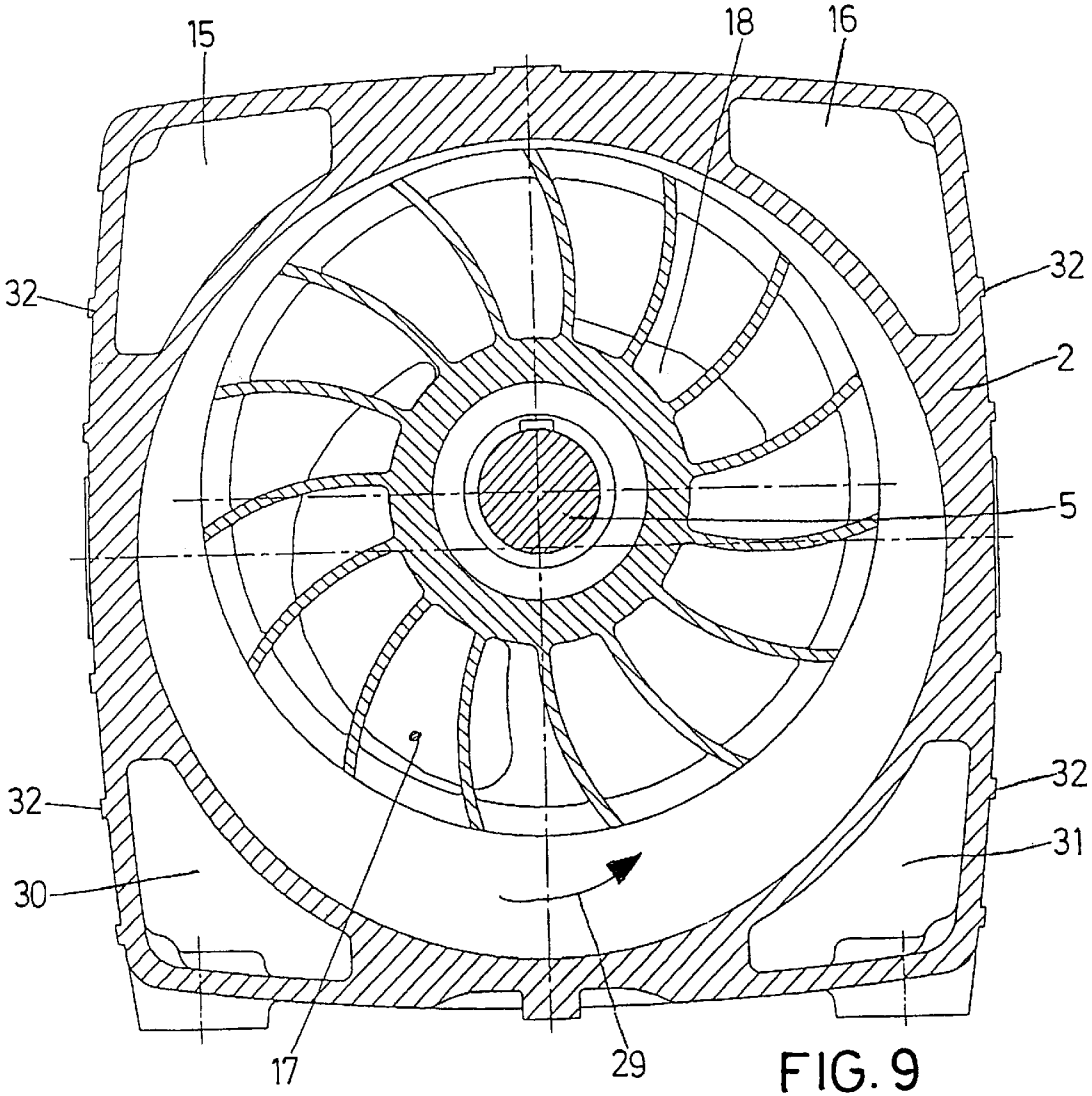
FIG. 9 is a sectional view on the line F—F in FIG. 8.

FIG. 8 once again illustrates the entire correlation in a longitudinal sectional view and FIG. 9 in a sectional view of the line F—F in FIG. 8. An arrow 29 characterizes the selected direction of rotation of the rotor shaft 5 and thus of the pump in FIG. 9. Of course the direction of rotation may also be clockwise, but this would mean an interchange of the suction side 17 and the delivery side 18. This sectional illustration offers a clear view of the upper channels 15, 16 which join to each other the inlet and outlet openings 7, 9 and 8, 10, respectively, of the two side shields 3, 4. Further channels 30, 31 are provided in the lower crotches, preferably serving to pass the operating liquid on, but also to function as dirt particle discharge channel. The outline of the rotor housing 2 is substantially square with bulging side faces. The side faces are equipped with ribs 32.

The longitudinal sectional view of FIG. 8 illustrates the two-chamber system with the central rib 33 dividing the two chambers. Strictly seen, the inlet openings 7, 9 in the side shields 3, 4 do not lie in this longitudinal section, however, for reasons of understanding, they have been projected on the plane of the drawing. In accordance with the illustration of FIG. 4, the chambers ought to be closed in this longitudinal sectional view.

As opposed to the known prior art, the sealing as well as the bearing arrangements of the rotor shaft 5 are integrated in the two side shields 3, 4. In this embodiment, the sealing arrangement comprises a gland packing 34 and three side by side shaft lip seals 35–37, the lips of the inward shaft lip seals 35, 36 inclining to the left and the lip of the outward shaft lip seal 37 inclining to the right. A grease sealing arrangement is provided between the two first shaft lip seals 35, 36, the filling of which takes place via a hole 38. Relief takes place via another hole 39. By alternative to the arrangement herein illustrated of shaft lip seals 35–37, axial face seals are conceivable too. The bearing 40—in this case in the form of a spherical roller bearing—is disposed on the seat of the bearing of the rotor shaft 5. The bearing 40 is fixed axially by a shaft nut 41 which can be screwed on. A cover 42 or cap 43, respectively, constitutes the lateral end, having a sealed opening for the shank of the rotor shaft 5 to pass through. The respective sealing arrangement is disposed in a sealing housing 48 and the respective bearing arrangement in a bearing housing 49. Both housings 48, 49 are screwed together, a seal 50 being disposed between the stop faces of the two housings 48, 49.

For the possibility of discharging the operating liquid whenever necessary, plugs 43, 44 are provided in the lower part of the respective side shield 3, 4 so that the operating liquid can be discharged from the right as well as from the left. Further, the illustration broken open at the lower right shows two plugs 45, 46 so that the supply of operating liquid can take place optionally from the end face of the side shield 3 or from the underside. For completion it must be mentioned that the inlet and outlet openings 7, 9 and 8, 10, respectively, in the two side shields 3, 4 can be closed optionally so that the connection of lines may take place optionally on the left and on the right side shield 3, 4. All the options mentioned above have been considered deliberately during construction for high flexibility in the choice of possible connections to be obtained. This is accompanied with the advantage that it is up to every operator to decide from which side to connect the lines most favorably.

What is claimed is:

1. A multiple-flow liquid ring pump (1) comprising a) a rotor housing (2) which encompasses a rotor disposed in a working area and two end faces;

b) side shields (3, 4) disposed on both end faces, i) each side shield (3, 4), on the side turned towards the other side shield, having an inlet opening (7, 9) and an outlet opening (8, 10) which are interconnected, ii) a suction port being provided for a supply line and a pressure port for a delivery line, iii) and each side shield having at least one further connecting port (11, 12, 13, 14);

c) the outer jacket surface of each side shield (3, 4) being flush with the outer jacket surface of the rotor housing (2); and d) the connection of the inlet (7, 9) and outlet opening (8, 10) as well as of the connecting port (11, 12, 13, 14) taking place via channels (15, 16, 30, 31) disposed in the rotor housing (2); characterized in that e) the rotor housing (2) has a substantially rectangular cross section;

f) the working area has a round cross section and is disposed substantially centric of the rotor housing (2); and g) the channels (15, 16, 30, 31) are disposed in crotches in the rotor housing (2) which ensue from the round working area.

2. A liquid ring pump (1) according to claim 1, characterized in that the rotor housing (2) has a substantially square cross section, the side faces being slightly curved outwards and rounded where they pass into the lateral edge portion.

3. A liquid ring pump (1) according to one of claims 1 or 2, characterized in that in one of the two lower crotches, one side shield (3, 4) or both side shields (3, 4) as well as the rotor housing (2) have only a single connecting port (11, 12, 13, 14) as well as a connecting channel (30, 31) for the supply of operating liquid.

4. A liquid ring pump (1) according to one of claims 1 or 2, characterized in that in both lower crotches, one side shield (3, 4) or both side shields (3, 4) as well as the rotor housing (2) have each a connecting port (11, 12) as well as a connecting channel (30, 31), one of the two connecting channels (30, 31) being a dirt particle discharge channel with connecting channels extending radially towards the working area.

5. A liquid ring pump (1) according to one of claims 1 to 4, characterized in that the side-shield end face area which is turned away from the rotor housing (2) and which comprises the inlet (7, 9) and outlet opening (8, 10) is skewed.

6. A liquid ring pump (1) according to claim 5, characterized in that the skew amounts to 45°.

7. A liquid ring pump (1) according to one of claims 1 to 6, characterized in that the inlet (7, 9) and outlet openings (8, 10) of identical design, which are disposed on the side shields (3, 4), are alternately closable.

8. A liquid ring pump (1) according to one of claims 1 to 7, characterized in that the sealing as well as the bearing arrangement for the rotor shaft (5) are integrated in both side shields (3, 4).

9. A liquid ring pump (1) according to claim 8, characterized in that the sealing arrangement is disposed in a sealing housing (48) and the bearing arrangement in a bearing housing (49) and the two housings (48, 49) are screwed together in a manner sealed (50) towards each other.

* * * * *